United States Patent [19]

Thompson et al.

[11] 4,166,729

[45] Sep. 4, 1979

[54] COLLECTOR PLATES FOR ELECTROSTATIC PRECIPITATORS

[75] Inventors: Joseph K. Thompson, Washington, D.C.; Robert C. Clark, Annandale; George H. Fielding, Alexandria, both of Va.; Harold F. Bogardus, Copenhagen, N.Y.

[73] Assignee: The United States of America as represented by the Secretary of the Navy, Washington, D.C.

[21] Appl. No.: 819,205

[22] Filed: Jul. 26, 1977

[51] Int. Cl.[2] ..... B03C 3/08; B03C 3/12; B03C 3/60

[52] U.S. Cl. ..... 55/138; 55/143; 55/145; 55/155; 55/159

[58] Field of Search ..... 55/138, 143, 145, 154, 55/155, 157; 428/415, 901; 252/501

[56] References Cited

U.S. PATENT DOCUMENTS 4,076,894 2/1978 Langley et al. ..... 428/901

4,077,782 3/1978 Drummond et al. ..... 55/155

*Primary Examiner*—David L. Lacey

*Attorney, Agent, or Firm*—R. S. Sciascia; Philip Schneider

[57] ABSTRACT

Collector plates for use in the second stage of a two-stage electrostatic precipitator comprise plates having non-conducting surfaces to which a coating of low conductivity, typically between 300 and 150,000 ohms per square, is affixed. One embodiment of such plates typically comprises a rigid, non-conducting plastic material coated with a material of low conductivity. Another embodiment of the present invention comprises a metallic plate coated with an insulating material of high dielectric strength, typically with a dielectric constant of at least 3000, to which the above mentioned low-conductivity coating is affixed. The collector plates may be mounted in such a manner as to maintain the airflow through the second stage of the precipitator in a direction virtually parallel to the surface of the plates.

4 Claims, 3 Drawing Figures

COLLECTOR PLATES FOR ELECTROSTATIC PRECIPITATORS

BACKGROUND OF THE INVENTION

This invention relates to two-stage electrostatic precipitators for use in filtering air and, more specifically, to low-conductivity collector plates suitable for mounting in a manner which will increase the efficiency of such precipitators.

There are two methods to increase the performance of two-stage electrostatic precipitators. First, all of the usual bypass air leaks associated with the structural fabrication of the precipitator can be blocked off by using means which will eventually break down and lead to the electrical shorting of the high-voltage elements. Secondly, the structure of the precipitator can be improved to minimize irregularities in the air flow and electric fields which irregularities always reduce the overall air-filtration efficiency of the precipitator.

A two-stage electrostatic precipitator typically performs its function by adding air ions (usually positive) to aerosol particles in the first or ionizing stage, thereby producing a high unipolar electric charge on each aerosol particle. Then, in the second stage, the charged aerosol is passed through a closely spaced array of metal plates oriented parallel to the air flow, alternate plates being grounded while the remainder are connected to the high-voltage power source, so as to attract the charged aerosol to the metal plates.

Although the two-stage electrostatic precipitator enjoys considerable use in home, commercial, and industrial installations, there is a major problem which restricts their wider application. This problem is the occurrence of spark discharges between the charged and grounded plates when the spacing between the plates is effectively reduced. There are several ways in which this reduction or narrowing of the airspaces between the plates can occur. The narrowing may be caused by the introduction of a fiber or needle-like single particle of dust or lint, the accumulation of smaller particles in the interplate field into a chain (this is a well-known occurrence with metal or carbon particles, but also occurs with thin materials), and the general building up of bulk deposited aerosol until the interplate spacing becomes small enough that the point-to-point electrical breakdown distance for air is reached.

Such spark discharges are in certain cases intolerable, ruling out the use of electrostatic precipitators in applications for which they would otherwise be well-suited. Such an undesirable case occurs where the dust of aerosol deposit is flammable, as with pyrophoric metals, greasy materials, or even some house dust. While in other situations the interplate sparking is not intolerable, it is undesirable nonetheless because it causes the production of irritant, toxic ozone, and nitrogen oxides, the disposal of dust deposits due to the explosive effects of the spark, and a firecracker-like noise of the spark.

Electrostatic precipitator plate electrodes which would perform all of the functions of the usual metallic electrodes, yet be non-sparking, would substantially enlarge the range of application of the two-stage precipitator, and eliminate the objectionable interplate discharge in present precipitators. In addition, such plates constructed of a suitable material and design and properly mounted eliminate the bypass air leaks found in prior-art electrostatic precipitators.

Therefore, it is an object of the present invention to improve the efficiency of the second stage of an electrostatic precipitator by the elimination of bypass air leaks.

Another object of the present invention is to eliminate the possibility of sparking in the second stage of an electrostatic precipitator.

Still another object of the present invention is to provide a simply constructed and inexpensive second stage for an electrostatic precipitator that can be used in environments where sparking between the elctrodes is intolerable or undesirable.

SUMMARY OF THE INVENTION

Accordingly, the instant invention comprises a plate for an electrostatic precipitator which is comprised of a rigid non-conducting material which is coated with a layer of low conductance material. A plurality of these plates may be placed in a non-conducting rigid frame constructed with slots in which to slide the plates to form the grounded and high-voltage collector electrodes of the second stage of an electrostatic precipitator. Alternate plates are connected to either the high-voltage source or to ground. In another embodiment of the invention, a conductive plate is coated with a high-resistivity insulating material and then a low-conductivity material. Both constructions increase the efficiency of the electrostatic precipitator and eliminate sparking between collectors. Thus such a precipitator may be used in environments heretofore believed unsuited for two-stage electrostatic precipitators.

BRIEF DESCRIPTION OF THE DRAWINGS

FIG. 2 (*b*) is a side cross-sectional view of a collecting plate comprising another embodiment of the invention.

DESCRIPTION OF THE PREFERRED EMBODIMENT

Figure 1:
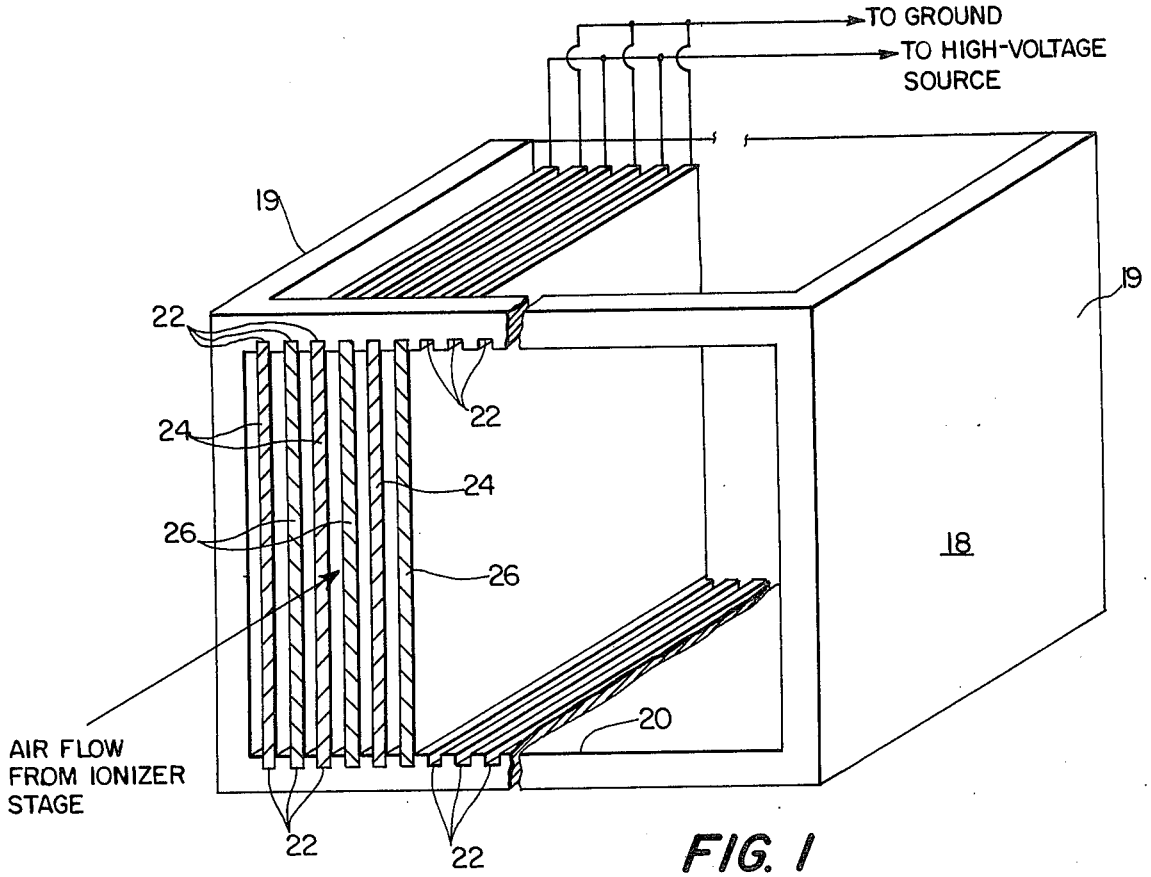
FIG. 1 is a pictorial illustration of the construction of a second stage of an electrostatic precipitator suitable for use with the present invention.

Collector plates in a two-stage electrostatic precipitator must have some conductivity in order to allow the establishment of the precipitating field and to carry away the current of precipitating charged particles. Neither of these effects, however, requires more than an extremely low conductivity. Basically, electrostatic precipitator plates (ESP) should have a low, well-controlled electrical conductivity, equivalent to a high lateral surface resistivity, such that the discharge rate of the assembly of plates acting as a capacitor is too slow to allow a spark. This follows from the well-known fact that the time constant, $\lambda$, for a capacitor discharge is $\lambda = RC$, where C is the capacitance of the ESP plate assembly in farads, and R is the resistance of the current path in ohms. The capacitance is, of course, fixed by the spacing and total area of the plates, but the resistance is, by the present approach, adjustable to give an RC product of one millisecond or more, which time constant is incomptaible with a spark discharge. A spark, on the other hand, is a localized, relatively high-current event, and cannot occur if a sufficiently high resistance is inserted in the circuit. As the following calculation will show, the resistance "seen" by an impending spark at a small spot in a plate is much larger than that seen by the low-valued but large-area particle-precipitation current.

For convenience, assume the collector plate to be circular. The resistance of an annulus of the plate is given by the equation:

$$R = \frac{1}{2\pi}[2.3K \log (r_2/r_1)],$$

where K is the resistance per square of the plate. For purposes of further explanation, it is useful to visualize the entire plate as an automobile wheel with a tire attached. The tire is analogous to the annulus, and the spot from which the spark originates would be comparable to the wheel upon which the tire is mounted.

Assume then, that the radius of the plate (wheel plus tire) is 10 cm. This dimension is $r_2$. The area at which a spark originates or is discharged (i.e., the wheel) will usually be of the order of 0.01 to 0.1 cm in radius. This dimension is $r_1$. Thus, using the above equation, and varying $r_1$ while $r_2$ remains constant, the overall resistance from spots of various radii, $r_1$, measured across the annulus, to the circumference of a plate having a radius of 10 cm ($r_2$) is given in Table I.

TABLE I

Resistance from a central charged spot to the circumference of a circular plate as a function of spot size. Plate radius, $r_2$ is 10 cm; spot radius is $r_1$.

| Spot radius $r_1$ (cm) | Plate-to-spot ratio, $r_2/r_1$ | Log $r_2/r_1$ | Resistance (ohms) $\frac{1}{2\pi}[2.3K \log(R_2/r_1)]$ |
|---|---|---|---|
| 5 | 2 | 0.3 | 0.11K |
| 1 | 10 | 1 | 0.37K |
| 0.1 | 100 | 2 | 0.73K |
| 0.01 | 1000 | 3 | 1.10K |
| | | | 10.83K |

As Table I shows, when the spot radius, $r_1$, is decreased while $r_2$ remains constant, the resistance of the annulus is increased. Since the power source contacts the collector plates at their edges, a path of resistance is created between the point at which the collector plate is connected to a high-voltage source, and the spot where the discharge occurs. The area over which the high voltage must travel is roughly equivalent to the area of the annulus, whose resistance is given by the above equation. Therefore, where the resistance per square of the annulus is high, a low current will arise and attempt to continue the flow of electrons across the plate from the high-voltage source to the area of contact of the dust particle.

As noted earlier, a spark cannot occur, but, even though sparks cannot occur, a "short" can. However, the "short" does not have its normally expected effect of shutting down the entire precipitator via tripping a fuse or circuit breaker. What happens is that only a negligibly small circular area surrounding the short experiences a reduced voltage, and the remainder of the area of the plate pair involved, as well as the rest of the precipitator, operates normally at full voltage. This interesting effect is a consequence of the uniformly distributed surface, or lateral, resistance of the ESP plates. The resistance between the point on the plate surface where the "short" excists and the voltage source to the plate is not proportional to the distance on the plate surface from the "short," but is actually a logarithmic function (as pointed out elsewhere herein). Hence, most of the resistance "seen" by the short, and correspondingly, the voltage drop (IR product) associated with the short, will be in a small zone in the plate surface surrounding the short. Thus, normal operation will continue until a large number of shorts affects overall performance. It is important to note that this effect does not result simply from low-conductivity plates or low-conductivity plate surfaces, but controlled low conductivity. In fact, for different sizes of precipitators having different capacitances, different conductivities or resistances should be provided in order to maintain a consistent RC product, or time constant, and an optimum immunity to sparking and short-circuiting.

Thus, the highly localized high-current spark will be obstructed by a high resistance, whereas the low-current particle discharge experiences a much lower resistance. Moreover, the particle discharge current is continuous, while a spark is an exceedingly brief discharge of the condenser system formed by the plates. If the resistance-capacitance time constant, RC, for the condenser discharge is large enough, the spark cannot occur at all since sparking is inherently a millisecond or microsecond event.

An electrostatic precipitator rendered spark-proof by the use of low-conductivity, light-weight plates can thus employ plastic elements to block bypass air leaks and improve efficiency as discussed earlier. Further, as illustrated in FIG. 1, the plates can be supported entirely at their edges by grooved plastic sheets. In this way, conventional precipitator plate-support components and insulators, which are heavy and which necessarily disturb air flow, can be entirely eliminated.

FIG. 1 is the second stage of an electrostatic precipitator which comprises a rigid plastic or other rigid light-weight, non-conducting-material housing 18 in which plate supports 20 (only 2 are shown), also constructed of such material, are connected between housing ends 19 and contain grooves 22 therein for use in securing high-voltage plates 24 and grounded plates 26 to the housing. The plates typically may be spaced 0.2–0.4 inches apart and any number of pairs of plates may be used, depending upon the efficiency desired. A typical number of such plates used in such a filter might be 24 pairs. All of the plates 24 and 26 are spaced equidistant from each other throughout the entire length of the filter. A high voltage, typically 3000 to 7000 volts, is applied to the high voltage plates 24. Air from the ionizer, or first stage, of a two-stage electrostatic precipitator is fed to the filter, or second stage, in a direction parallel to the plane of the plates 24 and 26, as indicated by the arrow. While passing through the plates, the charged aerosol in the airstream is attracted to the high-voltage plates 24 and removed from the airstream.

Figure 2A:
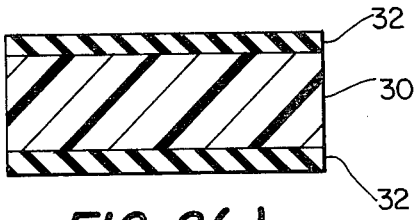
FIG. 2 (*a*) is a side cross-sectional view of a collecting plate comprising one embodiment of the invention.
Figure 2B:
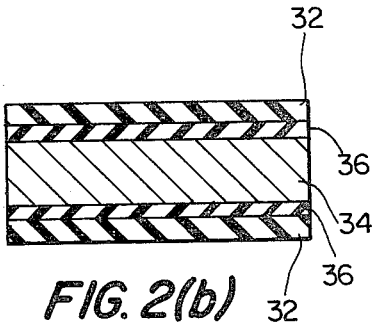

FIG. 2 (*a*) illustrates one construction which may be utilized for plates 24 and 26 in the electrostatic precipitator stage of FIG. 1. The plates may be constructed of a non-conducting, non-metallic material 30, such as a rigid plastic, with or without glass fiber. However, a glass-fiber-filled epoxy circuit board material has been found to yield good results; other examples are polyvinylchloride, polymethylmethacrylate, phenolic material or epoxy.

A slightly conducting coating 32, typically 3–5 mils thick, is applied to both surfaces of the material 30 to form the plates 24 and 26. Any semi-conducting material may be used for this purpose such as carbon black, as long as a conductivity of 300–150,000 ohms/square is obtained at the surface of the plate.

Another structure that can be utilized for the plates 24 and 26 is illustrated in FIG. 2 (*b*). A typical metallic plate 34 used in prior art electrostatic precipitators is coated on both sides with an insulating material 36 having a dielectric constant, typically a minimum of 3,000. To this insulating layer 36 is added another layer, a slightly-conducting coating 32, typically carbon black, or a semi-conducting material with a conductance in the range of 300–150,000 ohms/square.

In this manner, a very high plate resistance is achieved without affecting the normal functioning of the plates 24 and 26. The effect of the very high lateral resistance of the plates 24 and 26 is that not enough charge to produce a spark can flow from the total plate area to sustain a spark in time. These interplate spark discharges are largely condenser discharges, in which the total plate area comprises the condenser. By creating a very high lateral resistance on the plates 24 and 26, the time constant for a condenser discharge becomes so mismatched with the inherently brief lifetime of a condenser spark, that no spark discharge can occur.

The use of rigid plastic-type plates and frame allows the electrostatic precipitator to be constructed in such a manner that the air flow past the plates is smooth, and the precipitator thus created becomes more efficient.

Obviously, other embodiments and modifications of the present invention will readily come to those of ordinary skill in the art having the benefit of the teaching presented in the foregoing description and the drawings. It is, therefore, to be understood that this invention is not to be limited thereto and that said modifications and embodiments are intended to be included within the scope of the appended claims.

What is claimed and desired to be secured by letters patent of the United States is:

1. In an improved second stage of a two-stage electrostatic precipitator the improvement comprising:

an enclosed housing formed of an electrically non-conductive material including an axially aligned inlet and outlet;

a plurality of equally spaced, axially aligned grooves on the inner surface of said housing in oppositely disposed walls extending from said inlet to said outlet;

a plurality of collector plates assembled within said housing with opposite ends secured within said oppositely disposed grooves thereby aligning said plates in spaced parallel relationship between said inlet and said outlet.

each of said plates being formed from a non-conductive material, and a coating of low conductivity material on the outer surfaces of said non-conductive material, said coating of low conductivity material having a conductivity of between 300 and 150,000 ohms per square.

2. In an improved second stage of a two-stage electrostatic precipitator, the improvement comprising:

a plurality of equally spaced, parallel collector plates, each of said collector plates made of non-conductive material; and a coating of low-conductivity material on the outer surfaces of each of said plates, said coating of low-conductivity material having a conductivity between 300 and 150,000 ohms per square.

3. An assembly of improved plates for the second stage of a two stage electrostatic precipitator device in which:

each improved plate is formed from a metallic material having a coating of an insulator material on each side of said metallic material, and a film of low-conductivity material laid down on said coating of insulator material, the conductivity of said coating material being between 300 and 150,000 ohm per square and of such value that the total capacitance in farads, C, and the resistance in Ohms, R, of the current path along the low-conductivity material of said plates of said assembly provides an RC time constant which is too high to allow a spark discharge between any of the improved plates of said assembly.

4. Improved plates as in claim 3, wherein said resistance value is such as to provide an RC time constant of at least 1 millisecond.

* * * * *